US006533325B1

(12) United States Patent
Steidinger

(10) Patent No.: US 6,533,325 B1
(45) Date of Patent: Mar. 18, 2003

(54) INTEGRAL CARD AND METHOD OF MAKING

(75) Inventor: David J. Steidinger, Barrington, IL (US)

(73) Assignee: Tamarack Products, Inc., Wauconda, IL (US)

( * ) Notice: Subject to any disclaimer, the term of this patent is extended or adjusted under 35 U.S.C. 154(b) by 0 days.

(21) Appl. No.: 09/595,567

(22) Filed: Jun. 14, 2000

(51) Int. Cl.[7] ..... B42D 15/00

(52) U.S. Cl. ..... 283/105; 83/678; 83/695; 83/862; 283/81; 283/98; 283/108; 283/904; 428/42.2; 428/43

(58) Field of Search ..... 283/81, 94, 98, 283/100, 101, 105, 107–111, 904; 428/41.7, 41.8, 42.2, 42.3, 43; 83/678, 695, 862, 863, 865

(56) References Cited

U.S. PATENT DOCUMENTS

| | | | | | |
|---|---|---|---|---|---|
| 4,379,573 | A | | 4/1983 | Lomeli et al. | 428/42 |
| 5,007,191 | A | * | 4/1991 | Klein | 40/638 |
| 5,131,686 | A | | 7/1992 | Carlson | 283/75 |
| 5,198,275 | A | * | 3/1993 | Klein | 428/43 |
| 5,240,755 | A | * | 8/1993 | Zimmer | 428/40 |
| 5,320,387 | A | | 6/1994 | Carlson | 283/75 |
| 5,413,830 | A | | 5/1995 | Edwards | 428/40 |
| 5,439,255 | A | | 8/1995 | McIntire et al. | 283/62 |
| 5,466,013 | A | | 11/1995 | Garrison | 283/107 |
| 5,589,025 | A | | 12/1996 | Garrison | 156/268 |
| 5,595,404 | A | | 1/1997 | Skees | 283/116 |
| 5,662,976 | A | | 9/1997 | Popat et al. | 428/40.1 |
| 5,736,212 | A | | 4/1998 | Fischer | 428/42.2 |
| 5,782,497 | A | | 7/1998 | Casagrande | 283/110 |
| 6,010,090 | A | * | 1/2000 | Bushmaker et al. | 242/526.1 |
| 6,022,051 | A | * | 2/2000 | Casagrande | 283/107 |
| 6,054,170 | A | | 4/2000 | Chess et al. | 427/7 |
| 6,179,201 | B1 | * | 1/2001 | Chess | 229/92.1 |

* cited by examiner

*Primary Examiner*—Valencia Martin-Wallace
*Assistant Examiner*—Monica Carter
(74) *Attorney, Agent, or Firm*—Emrich & Dithmar

(57) ABSTRACT

A business form incorporates an improved multi-layer integral card utilizing microperforations to form ties which retain the card during machine handling and printing. The method employs a flexible steel die or engraved die cylinder with microperforations. The die penetrates all layers but the bottom laminate and the microperforations form ties to secure the card until removed for use. The combination and method of forming allows convenient removal of the card by an end user with edges on the removed card being smooth to sight and touch.

25 Claims, 5 Drawing Sheets

INTEGRAL CARD AND METHOD OF MAKING

FIELD OF THE INVENTION

The present invention relates to business forms which include an identification or promotional card for advertising, insurance, membership, and many other identification or promotional functions.

BACKGROUND OF THE INVENTION

In the manufacture of cards, cards are either affixed onto the form or they are an integral part of the form. It is well known in the forms industry to attach a plastic (or other suitable material) laminate onto a paper form using an adhesive which adheres the laminate sufficiently to the form to allow normal machine handling (printing, folding, etc.) and yet allows the card to be removed or peeled off by the recipient or end user. Such cards are often referred to as "affixed cards" and the material for such cards may be polyvinyl chloride, vinyl, and many other plastics, or even paper, with thicknesses typically between approximately 0.008 and 0.035 inch (8 to 35 mils).

In many applications, it is desirable to add printing or other data to the exposed surface of the card after it is adhered to the paper form but still in the machinery making the form (e.g., in-line printing). The stiffness of the card due to its thickness and material, the removable or peelable nature of the affixed card, and the height of the card above the supporting form can interfere with the printing process. Laser printers, for example, may jam or even become damaged when processing forms with affixed plastic cards. The raised edges of the card may catch on surfaces in the printer or the card may unintentionally come off the form (called "pre-dispensing") as the form traverses the non-linear paper path inside the printer.

Attempts have been made to improve the laser printability of affixed cards by recessing the cards into the form. One example recesses the card into a hole which is die-cut into the form. Two continuous ribbons of tape retain the card once it is placed in the die-cut aperture. This card is a separate piece added to a business form, as distinguished from a technique known a "integral" cards, discussed below, in which the card substrate is formed from the material of the business form itself. Other attempts to render affixed cards more amenable to modern in-line printers build up a separate layer of paper surrounding the cards or debosses the paper sheet to form a recess to receive the card to provide a smoother, less abrupt transition from the surface of the form to the surface of the card (on which it is desired to print).

Integal cards (also known as integrated cards) were developed to provide an identification card function with alternate materials and to improve compatibility with laser printers. Integral cards can be less costly than affixed cards and typically provide improved laser printer compatibility because the height of the print surface of the card relative to the surface of the form is reduced. The terms "integral" and "integrated" refer to the fact that at least one layer of a card is made of the form material itself. Prior integral cards include one in which a portion of the form receives at least one plastic laminate on at least one surface of the form (although integral cards may also be provided without laminates). The plastic laminate is often polyester with a thickness of approximately 1 to 5 mils. Other laminates may also be selected with different stiffness, transparency, ink or toner receptivity, cost and other characteristics. The laminate is bonded to the surface of the form, typically by a pressure-sensitive adhesive, although many different types of adhesive may be employed.

The form and laminate are then perforated in a closed path within the perimeter of the laminate to define an integral card. The central portion within the perimeter of the die-cut perforation defines an integral card portion; and the perimeter portion outside the die-cut and within the boundary of the lamination defines a border or frame portion. Again, the terms "integral" and "integrated" refer to the fact that the form ply itself provides one layer of the resultant card, as opposed to an affixed card which adheres a separate card onto a surface of the form and the form merely acts as a carrier.

The perforation of prior art perforated integral cards (as distinguished from "peel-out" cards, to be described below) typically extends continuously around the intended perimeter of the card and provides ties or connections between the card portion and the border portion. These ties typically measure about 0.008 inch (8 mils) wide or wider and are as thick as the combined thickness of the form stock and the laminates. As used herein, the "width" of a tie in a perforated card is the distance between adjacent perforations, and the "thickness" is the dimension of the tie parallel to the cutting motion of the perforator. To provide sufficient structure to secure the card to the form in "perforated" cards, there are typically six to eight ties per inch of perimeter of the die-cut perforation, but the number of ties per inch may vary considerably.

A major drawback to the prior art perforated integral card is that the ties are quite strong, especially when the card is laminated with one or two plastic layers. The strength of the ties makes it difficult for the end user to separate the card from the form. The ties must be broken or torn as the card portion is pushed out of the form. Also, the removed card shows evidence of the torn ties. The torn ties are unsightly and the edge of the card feels rough to the touch. The torn ties may even cause abrasions to the skin when polyester is used as the laminate layer or layers.

Another attempt to improve the integral card disclosed in U.S. Pat. No. 5,782,497 is referred to herein as a "peel-out" card. It involves special, usually proprietary materials providing a peel interface to hold the card in the business form until use. As opposed to rupturing perforations to remove the card out from the die-cut opening in the form, "peel-out" approaches provide an integral card which can be removed by peeling the card out of the die-cut opening using a special series of laminates and adhesives to obviate the use of perforations. The special series of laminates consists of (i) a backer ply;
(ii) a plastic laminate;
(iii) an adhesive or other means to bond the backer ply to the plastic laminate while permitting the two to be separated by a peeling action (the peel interface); and
(iv) a pressure-sensitive adhesive to bond the plastic laminate to the form.

The special series of laminates are applied to a portion of the form sheet and a perimetrically continuous (or "closed") die-cut defines the card portion and a frame portion. In this case, however, the die has a uniform cutting edge, not a notched perforator edge; and it penetrates the form and plastic laminate, but not the backer layer. The backer layer is the tying or connecting medium which secures the card in place during subsequent processing. The die-cut card portion is secured to the backer ply until it is peeled out. In some cases, a few (approximately four to eight) weak ties may interrupt the otherwise continuous die-cut and provide additional means (besides the peel bond to the backer ply) to retain the card portion on the form so it does not separate during processing in laser printers. The "peel-out" structure also includes an integral card with a patterned bonding layer between the backer and the laminate to make it easier initially to peel-out or break-out the card while providing sufficient bond to retain the card during processing, especially in a laser printer.

The special series of laminates and adhesives providing peel interfaces are proprietary items available from a limited number of suppliers. These materials are typically expensive and may not have uniform peel-out characteristics from one product or batch to another, and they do not provide a practical way for the form manufacturer to control or change the peel-out characteristic, as would be desirable. Another disadvantage of the peel-out card is that it requires very precise control of the depth of the die-cut. If the die-cut is not deep enough or is not uniformly deep, the card will not peel-out properly, if at all. If the die-cut is too deep, the backer layer may be weakened so that it tears out with the card, covering the typically clear plastic laminate. In this case, any data or illustration printed on the form (which would otherwise be intended to be revealed) is obscured by torn backer material. If the die-cut is too deep, the backer may even be cut through so that the card is not retained by the backer, allowing the card to fall out of the form. Thus, expensive, high-accuracy dies are required with careful control of the height of the die edge within 0.1 mil. Also, expensive, high-accuracy die-cutting cylinders are required, with extra mass, rigidity and painstaking control of cylinder run-out. These are expensive items to manufacture and thus their use further increases the cost of manufacturing cards.

In many cases, forms with integral cards have not only the special laminate on the back surface of the business form, but also a plastic laminate adhered to the top surface. Thus, control of the precise die-cut depth becomes even more difficult in the "peel-out" card forms. Form manufacturers need to die-cut through: a tough plastic top laminate, a relatively soft adhesive, the paper form itself, a relatively soft adhesive, another layer of tough plastic laminate, and, in some cases, a "peel interface" adhesive combination without die-cutting the backer layer, which typically is relatively thin, fragile paper. Sometimes, special, expensive die-cut edge geometries are used to alleviate the difficult task of cutting this combination of hard, tough materials and soft adhesives. These dies can cost as much as six times more than a die for typical label die-cutting. The task becomes even more difficult when forms are manufactured two-wide—that is, in two parallel streams, requiring that the side-by-side integral cards be die-cut simultaneously, with the same die-cutting cylinder so that for each cylinder revolution, more than one card is formed. Further, dies are often mounted two, three, or four around the circumference of a die-cutting cylinder. In such a case, each die must be held to the same exacting height tolerance of 0.1 mil to provide the careful control of cutting depth to assure each card in a web of cards can be properly peeled out by the end user. In practice, obtaining a set of two or more dies with the necessary height tolerance can be very difficult. While some cards are die-cut to the proper depth, others may be cut too shallow, and others too deep, thereby reducing the quality of the end product.

Another integral card known in the prior art and sold under the trademark Dualam™ and as described in U.S. Pat. No. 6,022,051 uses an even more complex and expensive laminate combination which is even more difficult to die-cut. The Dualam™ card allows the end user to print directly on the exposed paper face of the form. The end user then peels out the card intermediate, having a clear laminate on the surface opposite the imaging, turns it upside down, carefully replaces it in the die-cut opening in the form, with the printed surface against a clear laminate backer which is cut by perforation to the size of the laminate combination. The user then pushes the card through the clear laminate backer via the perforations in the clear laminate backer. This yields a laser imaged card, with a plastic laminate on both surfaces with the imaging underneath one laminate. This card requires an even more expensive, precisely manufactured die and is even more difficult to die-cut than peel-out integral cards, than does the "peel-out" card described immediately above.

SUMMARY OF THE INVENTION

The present invention applies a laminate (called the bottom laminate) to one side of a business form. A second laminate (the top laminate) may be applied to the other side of the form if a card is desired with laminate on both sides, but for simplicity only the bottom laminate is described herein. As used herein, a "laminate" may be a single ply of material, such as polyester, or it may be comprised of more than one lamina, depending on the application. In either case, a laminate is treated herein as a single layer.

The applied bottom laminate is slightly larger on all sides than the size of the desired card. A flexible steel die (typically mounted on a rotating die cylinder) or an engraved die cylinder then cuts the business form from the other or "top" side (i.e., not the side to which the bottom laminate is applied). The cutting edge of the die is formed into a perforator having very small notches (hence, the term "microperforator"). It is the notches in the perforator which ultimately form the "ties" or connections holding the integral card in the business form during subsequent processing after die-cutting, and which are severed by the user to separate the card for its intended use.

The notches in the die have a width which is preferably in the range of 0.001 inch (1 mil.) to about 0.004 inch (4 mils) but may be up to 5 mils. The depth of the notches may preferably be in a range of 1 mil to about 3 mils, and may be as great as 5 mils, but preferably the depth (or height) of the notches should not be substantially greater than the approximate height of the bottom laminate. The final nature and, dimensions of the ties depend mainly on the nature and thickness of the materials being used and the strength needed to secure the card to the form during processing.

The repeat pattern (or simply "repeat") of the ties (i.e., the number of ties per inch) is not critical, and may range from thirty ties per inch to over one hundred ties per inch. The repeat pattern may vary on the same card and preferably does in that it is desirable to have the corners of a card free of ties. Separation of the card is facilitated by having one or more free corners to grasp in separating the card.

A primary advantage of the present invention is that it reduces the overall thickness of a card forming a part of a business form as compared to many prior structures. This reduced thickness leads to better performance with laser printers as compared to the thicker prior art structures. Moreover, from the standpoint of a form manufacturer, and particularly when it is desired to manufacture integral cards, the manufacturing process on conventional web finishing equipment is made easier and provides more consistent results than many prior techniques. Further, the present system provides cost advantage because it uses less costly materials and fewer materials in many cases, particularly when compared with prior "peel-out" cards. It also employs dies which are less costly to make than comparable prior art dies intended for use in the production of integral cards. In addition, a form manufacturer employing the present invention has a convenient way to control the initial break-out characteristics of the integral card (i.e., by controlling the locations of the ties). The present invention also avoids the inconsistent characteristics of some former methods of separating integral cards from the rest of the business form by the end user. The end user is provided with a card which makes it easier to start the separation, as well as to complete the separation of the card. Moreover, the end product has edges which are smooth, not sharp as in some prior art structures, and appear to the touch and to the eye to be a cut edge, as distinguished from a torn perforation.

Other features and advantages of the present invention will be apparent to persons skilled in the art from the following detailed description of the preferred embodiment accompanied by the attached drawing wherein identical reference will refer to like part in the various views.

DETAILED DESCRIPTION OF THE ILLUSTRATED EMBODIMENT

Figure 1:
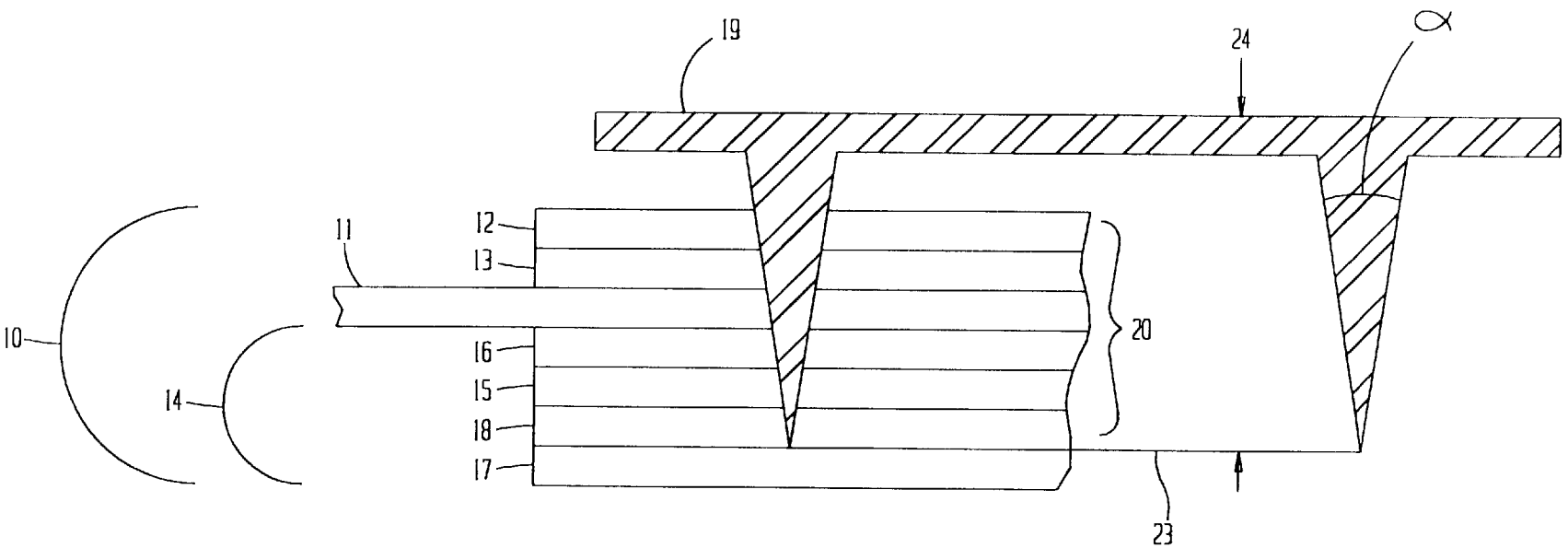
FIG. 1 PRIOR ART
FIG. 1 is a diagrammatic cross-sectional view of a prior art "peel-out" card business form, illustrating in an idealized form, the manufacturing process.

Referring first to FIG. 1, a partial cross-section of a prior art peel-out integral card form 10 is shown. A business form ply 11 may be in the form of a substantially continuous web with individual, connected sheets or unconnected sheets, as is well known in the art. The form ply 11 is often. paper, but could also be many other materials suitable for forms such as plastic, glassine, foil, or the like. A top laminate 12 is bonded to the top surface of form ply 11 via an adhesive 13 such as pressure-sensitive adhesive. The top laminate 12 is often polyester, but could be a wide variety of other materials: plastics, paper, foil, glassine, or combinations of materials, such as a scratch-off coating on a poly layer or a magnetic strip on a poly layer. Terms such as top and bottom, up and down, are used for convenience and do not limit the description of the invention to any particular embodiment. Moreover, in the diagrammatic views of FIGS. 1 and 3, the illustrated thicknesses of layers or materials should not be taken as any indication of dimensions or relative thicknesses.

A combination of layers known as a bottom laminate combination 14 is attached to the bottom surface of the form ply 11. The bottom laminate combination 14 comprises a bottom laminate 15 which is bonded to the form ply 11 by an adhesive 16. A backer 17 is peelably bonded to the bottom surface of bottom laminate 15 by an adhesive 18. Adhesive 18 may be a combination of an adhesive layer and a varnish layer as disclosed in U.S. Pat. No. 5,782,497. Adhesive 18 may even be deleted if backer 17 is a material suitably applied directly onto laminate 15 to provide a peel interface. Such a laminate combination is sold under the designation "SC Dry Lift™" by Precision Coated Products of Batavia, Ill. As with the top laminate 12, the bottom laminate 15 may be a variety of materials. Adhesive 16 is typically pressure sensitive, but it may be a variety of other bonding agents or means.

Figure 2:
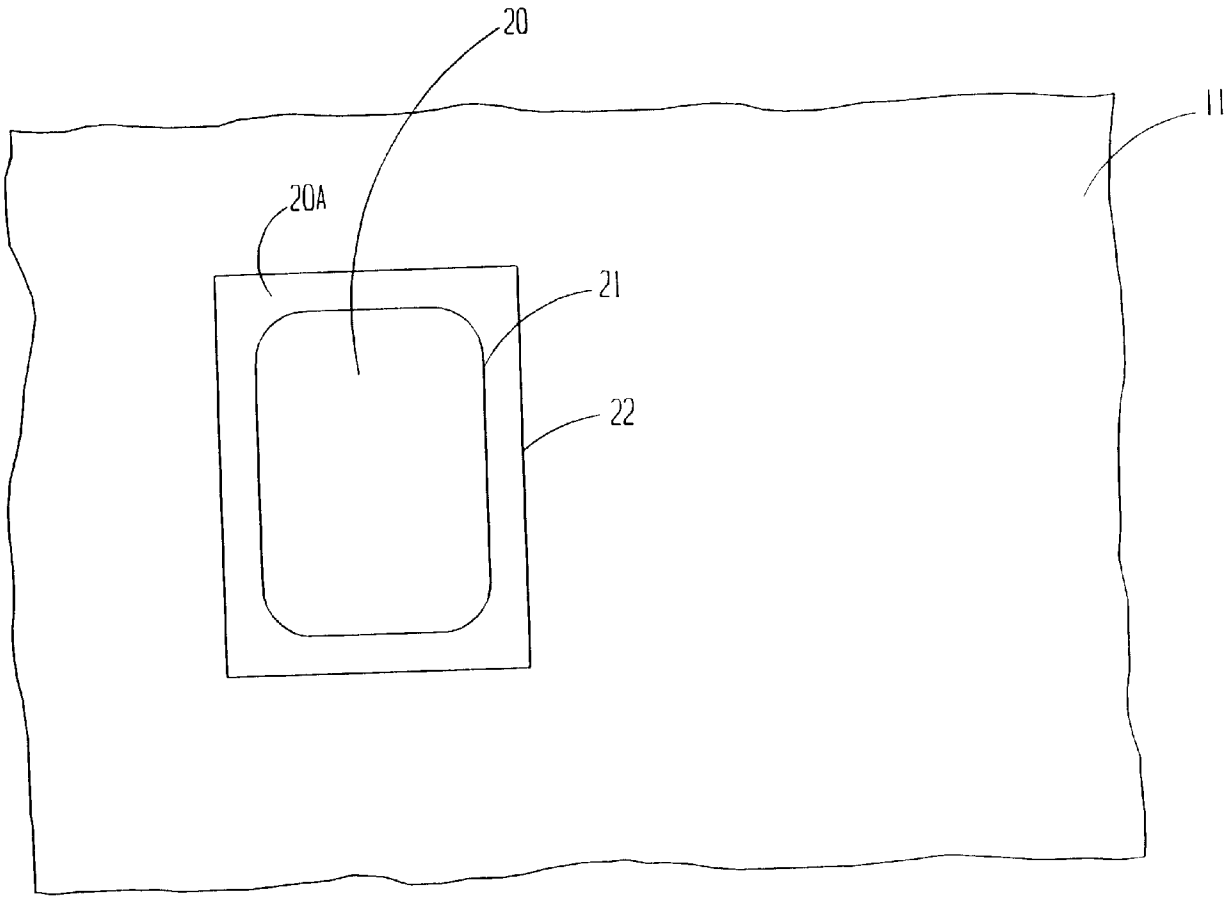
FIG. 2 PRIOR ART
FIG. 2 is a top view of the prior art integral card business form of FIG. 1.

A cutting die 19 having a linear or straight cutting edge 23 (as opposed to a notched or perforator edge) is shown in vertical cross-sectional to illustrate the depth of cut into the peel-out integral card form 10. The die 19 penetrates all layers of the card form 10, except for the backer 17. This creates a removable card portion 20 or "card intermediate" (see FIG. 2) within the perimeter of the die-cut 21 and held to the form by a peelable adhesive or other peel-out interface. FIG. 2 also shows the perimeter 22 of the top laminate 12 which is larger than the perimeter of the die-cut 21 in all directions to form a frame or border 20A. The card portion therefore includes that part of form ply 11, top laminate 12, adhesive 13, bottom laminate 15, and adhesive 16 within the closed cutting perimeter 21 of the die. The peelable adhesive layer 18 may or may not peel-out with the card portion 20, It is, however, desirable that peel adhesive layer 18 remain on backer 17. In some cases, a portion of the peelable adhesive layer 18 may peel out with the card portion, but that is not desired. This can occur with one known form of integral card where a portion of a varnish coating (a component of the peel interface) may be detected on the bottom surface of the card portion 20 when card portion 20 is peeled out, particularly toward the ends of the card. In any case, it is desirable that the peelable adhesive 18 not be sticky or tacky when the card portion 20 is removed.

If the die 19 does not penetrate down to the upper surface of backer 17, the card portion 20 within the perimeter of the die-cut cannot be peeled out properly because one or more layers 11, 12, or 15 still connect the card portion 20 to the remainder of the form. This interferes with the peel function. If the die 19 penetrates too far and cuts substantially into the backer 17, the part of the backer 17 within the perimeter of the die-cut may tear out with the card portion 20, thus obscuring printing which may be on the back of form ply 11, or worse, the card portion 20 may fall out of the integral card form 10 prematurely or while processing the card form 10 in a laser printer. This could not only spoil the card form 10, but also interrupt the laser printing operation or even damage the laser printer.

The combination of relativley hard top laminate 12 and bottom laminate 15, and soft adhesives 13, 16 (and sometimes 18), makes it more difficult to die-cut the card portion 20 without also cutting or scoring the backer 17. Sometimes, the flank angle $\alpha$ (FIG. 1) of the die 19 must be reduced to penetrate the relatively thick sandwich of materials. This not only adds cost for producing a special die, but also weakens the die edge 23, reducing die life. The die height 24 must be very accurately controlled (to within 0.1 mil), all the way around the perimeter of the die edge to assure proper die-cutting. This also adds cost to the die and to the process of manufacturing cards.

If multiple dies are used, all dies must be held to the same exacting height tolerance. For example, when placing cards on a 3⅔ inch repeat, using a 22 inch circumference rotary die cylinder, six dies (or one die with six die patterns on it) must all be made to the same exacting height tolerance. Often, forms are produced two-wide (i.e., side-by-side) and the required number of dies is doubled. The die-cutting equipment, such as a rotary die-cut press must similarly meet exacting runout tolerances (typically 0.1 mil T.I.R.). These accuracy requirements are difficult to achieve in the production environment and this leads to quality problems, waste, and increased costs.

Die-cutting equipment may also have insufficient rigidity and this may be evidenced by excessive cutting depth on the lineal portions (in the direction of rotation and form travel) and/or insufficient cutting depth on lateral portions (90° to the direction of rotation).

Figure 3:
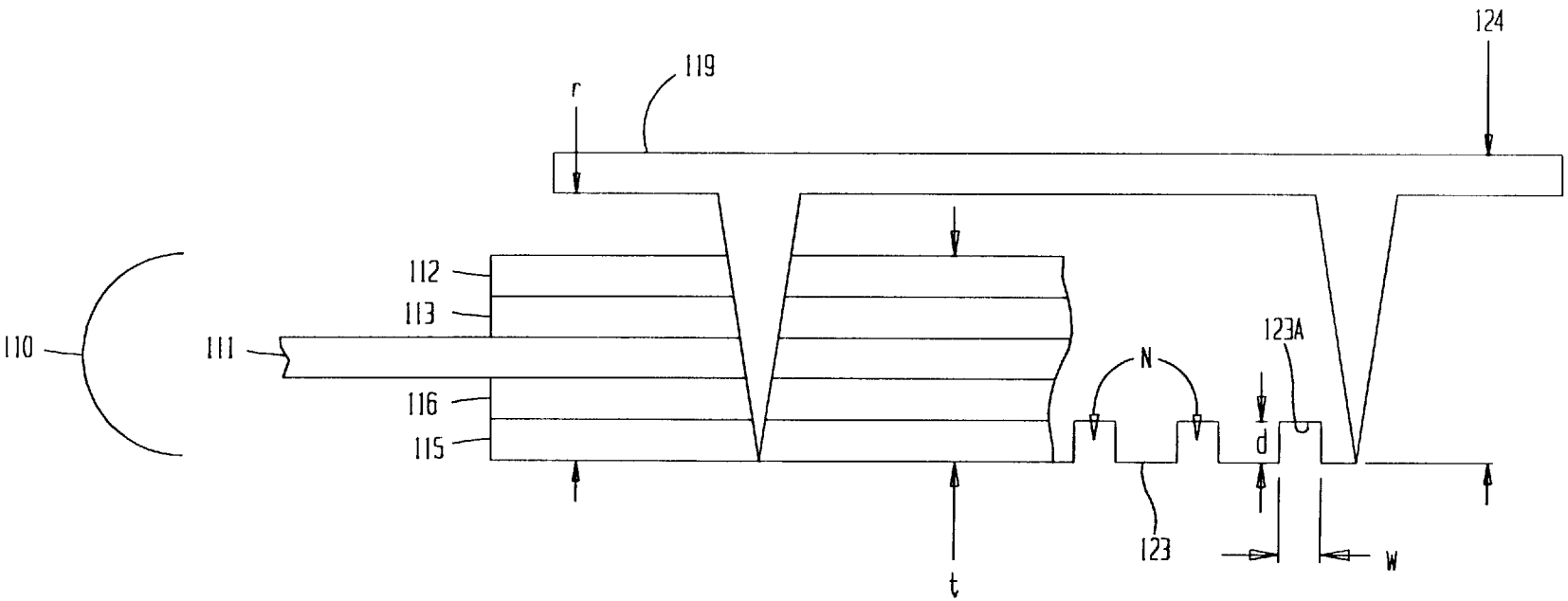
FIG. 3 is a diagrammatic cross-sectional view of an integral card constructed according to the present invention with top and back laminates, together with a cross-sectional view of the microperforating cutting-die illustrating the depth of the die-cut relative to the business form.

Turning now to the improvements of the present invention, the laminates of the inventive integral card form as shown in FIG. 3 are unlike the prior art peel-out integral card form just described in that the peelable adhesive layer 18 and backer 17 of the prior art are deleted. This provides immediate advantages over the prior art peel-out integral card: the inventive card assembly is thinner and less expensive.

In the illustrated embodiment, the layers of the inventive card assembly are numbered similar to the layers shown in FIG. 2, but with a "1" preceding. Form ply or "sheet" 111 is laminated on its top surface with a top laminate 112 by adhesive 113. The top laminate 112 and adhesive 113 maybe eliminated, if desired, with satisfactory results. The bottom surface of form ply is laminated with bottom laminate 115 by adhesive 116.

Laminates 112 and 115 may be of a variety of materials, but are often transparent polyester. Similarly, adhesives 113 and 116 are often a hot-melt, permanent, pressure-sensitive adhesive, but may alternatively be a variety of adhesives with various properties, such as high or low temperature resistance, tamper indication, intentional removability or re-positionability, opacity, hot melt, rubber base, acrylic base, resin base, latex emulsion, and others. In any case, the laminates 112, 115 are directly and permanently affixed to the form sheet or ply 111 in the sense that the laminates, once applied as intended, cannot be removed without at least partially destroying the form. The approximate thicknesses of the various layers may be as follows:

Form ply 111: 3 to 10 mils

Top and bottom laminates 112 and 115: 1 to 5 mils (each)

Adhesive layers 113 and 116: 0.4 to 0.8 mils (each)

It is understood by those skilled in the art that the invention may be practiced with any combination of the above thicknesses, or with thicknesses beyond the range of those indicated. Integral cards are often configured to yield a total card thickness (indicated at tin FIG. 3) of 8 to 12 mils.

An important difference between the inventive integral card forms and all other prior art integral cards is found in the die-cut which is in the form of a microperforation to be described. The die 119 shown in FIG. 3 may be a flexible steel die for use with a magnetic die cylinder, but it may also be a cutting edge machined or engraved on an engraved die cylinder, a flat die used with a reciprocating flat bed press, or other suitable types of known die-cutting technologies. Dies with a series of notches along the cutting edge are known in the industry and when used to die-cut a particular medium like paper, the series of notches creates a sequence of ties and cuts commonly known as perforations. That is, a perforating edge of a die has a series of alternating puncturing or cutting edges (called "cuts" or "slits") and notches (sometimes called "ties" because they form bridging portions, or ties, between two sections of the material being perforated). As used herein, the term "microperforator" means that there are approximately 30 or more (up to approximately 120) perforations per inch. Further, whereas the notches shown in the drawing are rectilinear other shapes, such as sawtooth or A-shape, may be used.

Using current microperforating techniques, the width of the ties (formed by the width W) of the notches N in the cutting edge 123 can be made much finer than have been available in the more recent past. The edge 123 of the die is notched at N to create microperforations. Such dies are available through Zimmer Industries, of Hawthorn, N.J., with a notch width or "tie" W as small as 1 mil. The depth or height of the cut d (FIG. 3) may be approximately the same as the width W of a tie, but it may also be independent of the width W Moreover, the depth d may be approximately equal to the thickness of the bottom laminate, but this also is not essential, as will be further explained presently.

Prior art integral card perforating used the thickness of the material being die-cut to determine the depth d of the tie. The belief was that the depth d of the notch needed to be approximately the same as the thickness t of the medium (which could be a number of layers) being die-cut. For a total card thickness t of 8 to 12 mils, a corresponding notch depth d would be selected at 8 to 12 mils. The notch width W was typically set at the same dimension as the depth d because of the process of manufacturing the die. Therefore, the notch width W typically equalled the notch depth d, so the notch width W was 8 to 12 mils in the example. The card die-cut with these relatively wide ties yields an arrangement having ties that are not only 8 to 12 mils wide, but also 8 to 12 mils tall or thick. It is very difficult to remove such a card by breaking the ties, particularly when plastic laminates are used. Moreover, the torn ties yield edges with a very ragged appearance. The perforated edges also feel very rough and the torn ties, with polyester laminations 112 and 113, can feel very sharp and in some cases, cut one's skin.

In the practice of the present invention, the depth d of the perforation notches N may be equal to or slightly less than the thickness of the bottom laminate 115. The reason for this is that all other layers (112, 113, 111 and 116) will then be cut by the surface 123A of the die which is relatively blunt and defines the top of the notches N of die 119. The bottom laminate may be slightly, but not entirely, cut in this area. For example, if the thickness of the bottom laminate is 5 mils, the depth d of the notches N may be 4 mils (in some cases it may be even less). The ties must be left with sufficient strength to stabilize and retain the card during subsequent machine handling.

An advantage of the present invention is that the depth of the notch does not necessarily have to be substantially equal to the thickness of the back laminate to make an integrated card. As long as the depth of the tie is within the approximate range of 1 to 5 mils and the width the tie is maintained in the same range, the depth of the cut need not be substantially equal to the thickness of the last ply to be penetrated by the cut of the perforator.

Thus, a manufacturer could have in inventory, a microperforating die with notches of 3 mils deep by 3 mils wide. By way of example only, such a die could be used to make integral cards from a combination of form stock having a thickness of 4 mils and a back laminate having a thickness of 2 mils. The depth of the notch is slightly greater than the thickness of the laminate, and the tie is formed, in effect, by the thickness of the back laminate and 1 mil of the thickness of the form. Nevertheless, separation of the card is rendered easy because the thin ties are easily torn, one at a time. The same die could be used with a form material 2 mils thick and a back laminate 4 mils thick. Again, the tie is 3 mils wide and 3 mils thick, and easily torn, with smooth resulting edges.

Persons skilled in the art will appreciate that the same results will be obtained if a top laminate 112 and adhesive 113 are added because it is the sectional area of the resulting ties and the ability to separate the ties that are being defined. Thus, the nature of the material of the back laminate will have some effect on the strength of the ties, as well. In these examples, it has been assumed that the die penetrates the form and then the back laminate, but this order could be reversed with like results; but, at least in the case of a single back laminate, the ties would be comprised primarily of the material of the form. Thus, this is a substantial saving of expense and time to a form manufacturer who may be able to use dies already in inventory to make new and different integral cards.

The width W of a notch may be the same as the depth d, but is not necessarily so. The width may be less or more, but typically may be in the range of from 1 to 5 mils. The repetition rate of the notches (and thus the perforations) may be in the range of 30 or less to 100 or even 120 notches per inch, but this also is not critical and may vary widely, and it need not be the same over the entire card perimeter. That is, the repetition rate of the notches in different dies may vary, and it may vary on the same die. For easier separation of the card by the user, the cross sectional area of the ties should be less than about 10 square mils, depending upon the materials being used. A few samples will readily assist the manufacturer to suitable dimensions for the ties. A "square" mil is a square area of one mil on each side.

The (i) non-critical nature of the width W and depth d and the (ii) essentially full penetration of the die edge 123 through the card assembly 110 provide several important advantages over present commercially available peel-out integral cards described above. First, it is much easier to die-cut through the card assembly 110 than it is to die cut up to, but not through, a backer 17 (FIG. 1) as in the peel-out integral card assembly 10. For the inventive card, the die height 124 (FIG. 3) need not be made to as exacting a height tolerance (within 0.1 mil or 0.0001 in.) as for the peel-out card assembly 10. For example, if several dies 134 (FIG. 5) with a nominal height 124 of 22.8 mils are placed on a magnetic die cylinder 133, one die may be slightly too tall (22.9 or even 23.0 mils) without adverse results. In this case, the edge of the die is crushed very slightly as it contacts the surface of the anvil cylinder 135 so that the height of the taller die is adjusted to cut through the card assembly 110 as desired. If a die which is too tall is utilized with a prior art peel-out integral card 10, that die will cut deeper than the others and tend undesirably to cut into the backer 17. In the inventive integral card assembly 110, a die 134 which is slightly too low may not quite contact the anvil cylinder 135. A slightly low die (22.7 or even 22.6 mils) will typically still 'burst' or cut the card assembly 110 due to the build-up of forces caused by pressing the die edge 123 through the various layers while supporting the laminates with a hardened anvil (as distinguished from another laminate). In other words, the downward cutting forces are typically sufficient to overcome the shear and tensile strengths of the last 0.1 or 0.2 mils of the bottom laminate 115. And, if a very thin portion of the laminate remains unsevered, it may likely be sufficiently scored and weakened to allow the card portion 120 to be pushed out of the form 110 when desired. In contrast, if a die which is slightly low (e.g., 22.6 mils) is utilized to attempt to make a prior-art peel-out card, the bottom laminate 15 will not be sufficiently scored or. weakened due to the presence of the relatively soft backer 17. In this case, the prior art card 20 will not peel-out or the bottom laminate 15 may tear when removal is attempted.

In general, die cutting through the inventive integral card assembly 110 is easier than die cutting up to a backer 17 of a prior art card assembly 10 because it is easier to cut through to a hardened steel anvil cylinder 135 than it is to cut down to, and no farther than, a relatively soft backer 17 which is typically paper or poly material supported on an anvil cylinder. Therefore, for the inventive card assembly 110, the required levels of precision of the dies and the die cutting apparatus are advantageously reduced.

Secondly, the card portion 120 of the instant invention is readily removed, and presents smooth edges with a considerably wide range of microperforation specifications, as described above. For a polyester or similar bottom laminate 115 with a thickness of 1 to 5 mils or more, the width of the ties W (and corresponding depth d) may range from about 1 to 5 mils with a repetition rate of about 30 to 120 ties per lineal inch of die edge perimeter. This will provide a card portion 120 securely retained for laser printer or other processing, yet readily removed when desired.

Further, the overall thickness of the card assembly 110 may be substantially increased from the typical 8 mils, so long as the die relief r is sufficient to accommodate the thickness of the card assembly t plus about ten percent of card thickness t for clearance. A thicker card may be desirable for its increased stiffness or to allow compatibility with other applications. For example, the invention has been practiced with the form layer 110 comprised of thicker paperboard stocks of about 18 mils thickness, such as canned beverage cartons. The same die cutter and dies used for thinner business form stocks successfully die-cut the thicker paperboard material, producing a considerably thicker and stiffer card 120 compatible and integral with a paperboard beverage container. The resulting thicker card portion 120 made with paperboard material is securely retained yet readily removable, just as with the thinner paper form material. This allows an attractive promotional card, such as a phone card or identification card, to be manufactured integral with a beverage carton, with the same tooling and apparatus as used for thinner business forms. It would be difficult, if not impossible, to make prior art integral card assemblies 10 of a similar thickness using existing web finishing equipment because of strength and precision limitations.

The force required to remove the card 120 may be varied by changing the width (W) or cross sectional area (Wxd) of the ties. The removal force is primarily determined by the physical strength properties of the bottom laminate 115 and the cross sectional area, Wxd, of the ties, and, to a lesser extent, the depth of the ties.

The repeat pattern of the ties does affect an important aspect of card performance—the resistance to undesirable removal or 'pre-dispensing' of the card when processing in a laser printer or other form handling apparatus. In some cases, the form web 110 must wrap relatively small diameter rollers or corners, under tension. Under these conditions, in the case of prior art peel-out integral cards 10, the cards were sometimes known to 'pre-dispense' or peel off the backer 17. To avoid this, material manufacturers must carefully control the peelable adhesive layer 18 to balance the ease of intentional removal with resistance to pre-dispensing during processing. In some cases, form manufacturers have been advised to add small nicks to the dies, typically two to four across each of the leading and trailing edges, to resist pre-dispensing. Form manufacturers were typically on their own as to when and how to add these nicks. Nicks were made with crude tooling, such as chisels and razor blades, with the expected result of inconsistent quality. The nicks could be so large as to cause the card 20 to delaminate or tear upon removal, or the nicks might be so small as to be ineffective in resisting pre-dispensing. In contrast, the dies used for the inventive card assembly receive uniformly accurate microperforations at a reasonable cost. Further, because the inventive card 120 is intended to be pushed or torn out of the form rather than peeled-out, there is far less tendency to delaminate or tear the card 120 during removal. The inventive card's 120 resistance to pre-dispensing is easily controlled by varying the repeat pattern of the ties. For example, a card with 100 ties per inch will better resist pre-dispensing than a card with 60 ties per inch. This is because there will be a larger number of connections between the card portion 120 and the adjoining edge of the form to resist tensile forces commonly found in processing apparatus, such as press or rewinding tension or intermittent feeding. Yet, so long as the width of the ties is not varied, the force required to remove the card 120 will remain essentially unchanged because removing the card breaks the ties one at a time, and the smooth edge of the removed card is not noticeably affected.

The inventive card also effectively resists separation due to tensile forces in bending, such as those generated as a form 110 wraps around a small radius roller or corner. Unlike prior art perforated card assemblies with ties as thick as the card portion thickness t, the ties in the inventive card have a thickness which is roughly as thick as the bottom laminate 115, thus the stresses generated in bending, which are directly related to the thickness of the tie dare greatly reduced. This allows the inventive card to pass smoothly around a tight radius without buckling, breaking ties or pre-dispensing.

Figure 4:
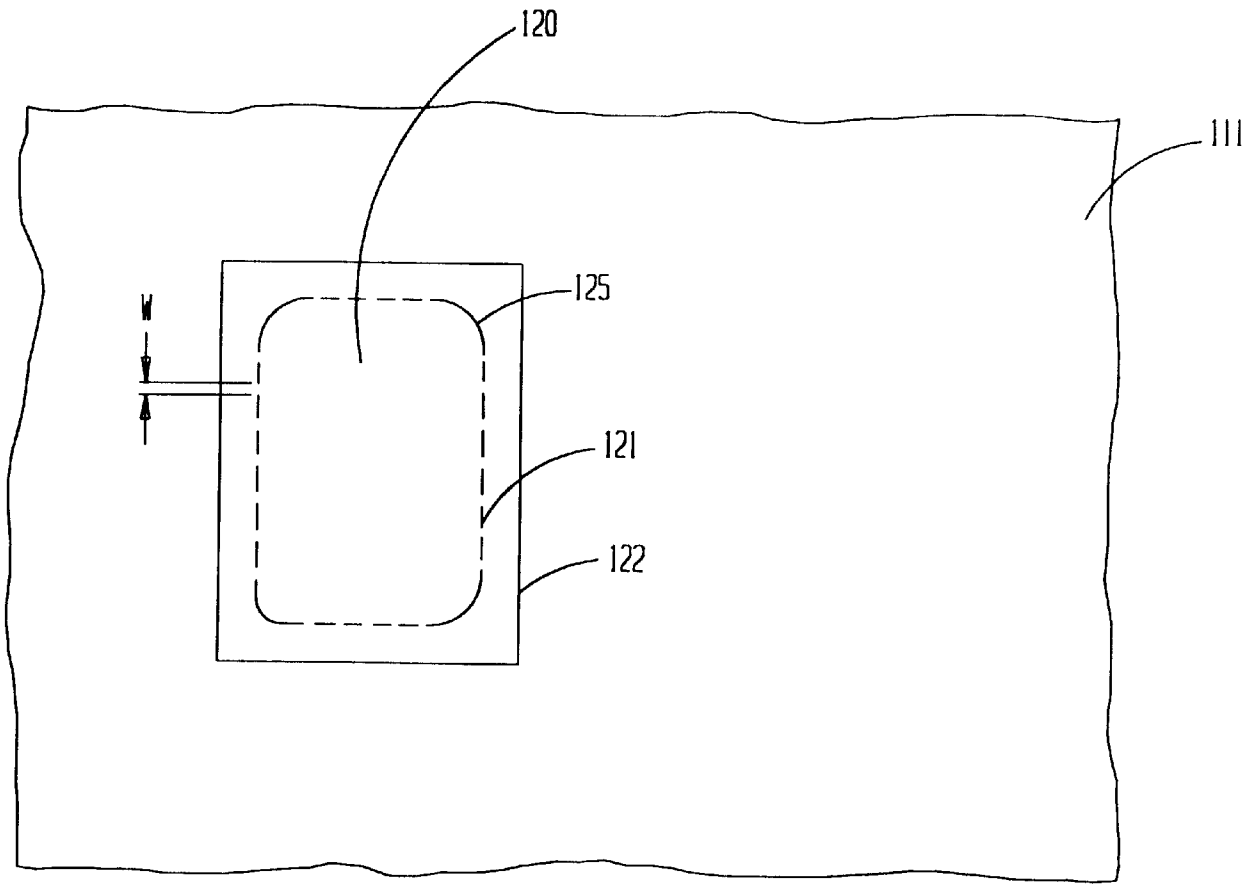
FIG. 4 is a top view of the perforated integral card form of FIG. 3.

The inventive card assembly 110 also provides a convenient method to initiate intentional removal of the card 120. In prior art perforated (as opposed to peel-out) cards, the perforation typically remains essentially uniform and constant around the entire perimeter of the die-cut 121 edge (FIG. 4). In the inventive card 120, the perforation repeat pattern may be changed at one or more portions of the perimeter 121 so that the initial removal force may be reduced. For example, as shown in FIG. 4, the perforations may be deleted at one or more corners 125 of the card, and a continuous cut substituted. To accomplish this, the die-cut is continuous (no ties) at the corner, and penetrates all the way through the thickness t of the assembly 110 and the card removal may be more easily initiated at this corner 125 because there are (locally) no ties to break. In some applications, all corners 125 could have continuous cuts to ease removal initiated at any corner. Similarly, in other applications, the continuous cuts extend beyond the corners, or alternatively, continuous cuts could be provided along one or more lineal portions of the die-cut perimeter 121.

In yet another embodiment, the repeat pattern of the ties could be varied along one or more portions of the die-cut perimeter 121 to vary the ease of removal. For example, one (or more) portions of the perimeter may have ties spaced at 40 ties per inch to allow easier initiation of removal at this portion of the perimeter, while the balance of the perimeter could have ties at 80 ties per inch. Similarly, it is possible to vary continuously the repeat pattern of ties to make more gradual the transition between easy initial removal and secure resistance to pre-dispensing.

Another advantage of the instant invention comes from deleting the peelable adhesive 18 and backer layer 17 of the prior art peel-out integral card. This substantially reduces the cost of the inventive integral card because the peel interface requires the most engineering and control on the part of the laminate supplier to assure the desired peel characteristics. The overall thickness of the inventive card is also reduced by approximately 2 mils, a substantial percentage of the overall thickness of a typical prior art peel-out integral card assembly 10, e.g., approximately 20% of typical integral label assembly 10 thickness of 10 mils. This improves laser and other printer compatibility, because in general, laser printers operate with fewer jam-ups or other complications with. a sheet of uniform thickness. Any 'bumps' such as integral card laminations can lead to printer processing problems such as the edge of a card laminate catching on an edge of an over- or under-lying sheet in a stack of forms in the printer's infeed or outfeed hopper. The various nip points between rollers in a laser printer must also deflect or deform to allow passage of the extra thickness of the top and back laminates and this can cause imaging and feed problems. Thus, the reduction in thickness allowed by deleting the peelable adhesive 18 and backer 17 layers improves feeding within laser printers.

Forms are often fed from folded packs or stacks of individual sheets. The additional thickness of the top and bottom laminates, especially if asymmetrically located on the surface of the form, leads to pack or stack leaning. In the case of packs of continuous forms, the pack may lean so much that it slips or falls out of position. In the case of a stack of sheets, the printer's in-feeding pick-up mechanism functions best when the top of the stack is approximately level. Reduction in the thickness of the top and bottom laminates advantageously reduces leaning, allowing a larger number of forms to be staged for laser printer processing. The deletion of layers 17 and 18 in the inventive card assembly 110 provides a significant reduction in overall form thickness t and therefore improves stacking and feeding of forms into and out of laser printers.

The preferred embodiment of the invention may be readily manufactured on existing web finishing systems which can cut and apply patches of laminate and die-cut the card portion, such as the Versa-Web® Model available from Tamarack Products Inc., of Wauconda, Ill.

Figure 5:
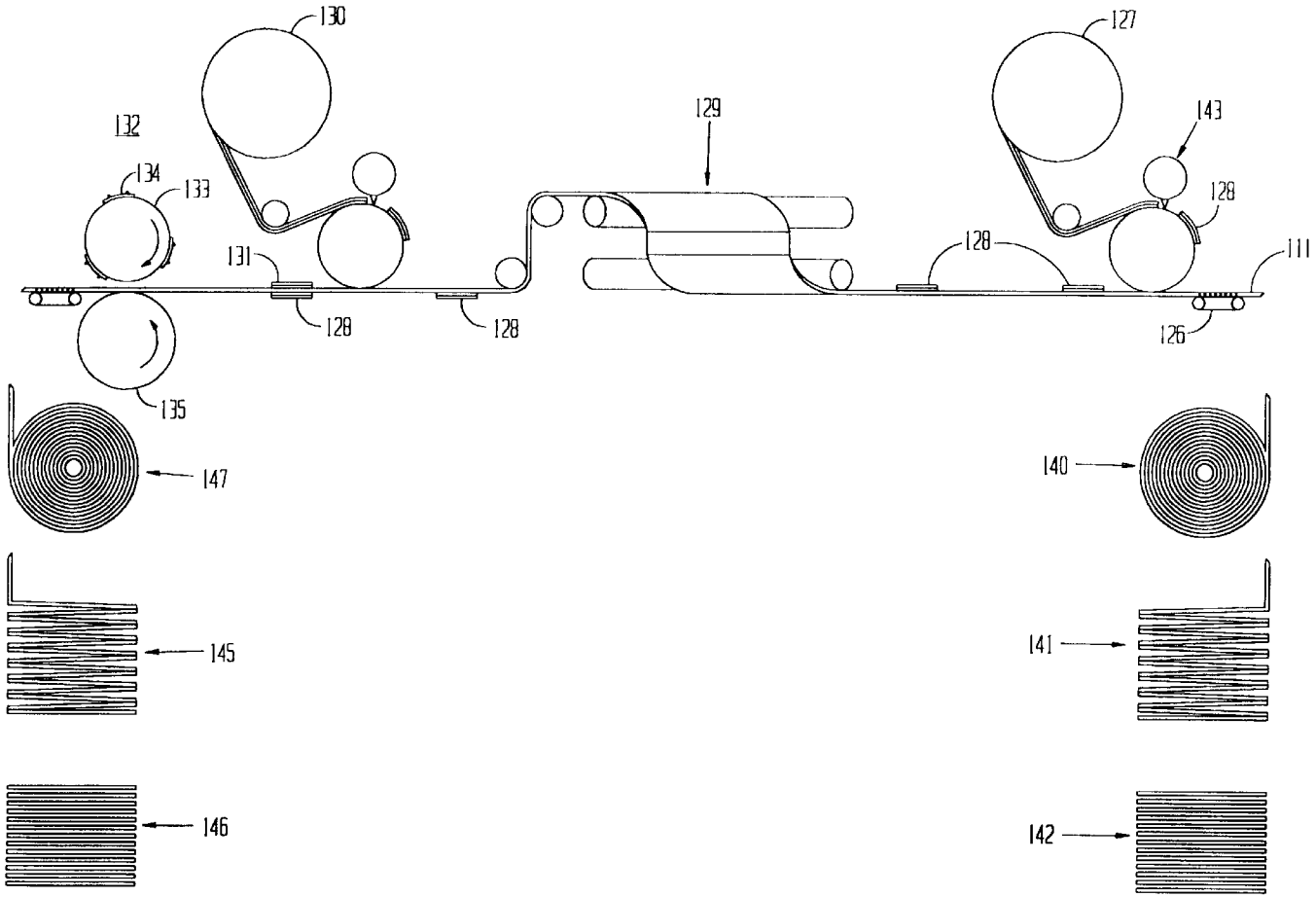
FIG. 5 is a schematic view of apparatus for manufacturing the integral card assembly of the present invention.

FIG. 5 is a schematic illustration of a web finishing apparatus for manufacturing the preferred embodiment of the invention in one pass. Existing apparatus may be capable of manufacturing the invention in two passes (one pass each for applying top and bottom laminates). Web 111 may be in the form of a source roll 140 or a folded stack of joined sheets 141, or a stack of individual sheets 142. Web 111 may be transported in a variety of well known ways, including the combination of marginal line holes and pin tractors 126, tensioned web and feed rollers, individual sheets and vacuum belts, individual sheets and friction belts with lug position control, or other known web or sheet conveyance means. A source roll 127 comprising laminate roll 115, and adhesive coating 116 is cut into segments 128 by cutting means 143 and applied directly to web 111 using known feed, cut-off, and vacuum applicator systems as supplied by Tamarack Products, Inc. of Wauconda, Ill., or peel-off systems as disclosed in U.S. patent application Ser. No. 08/868, 935 and practiced by the Van den Bergh Equipment of Belgium. The adhesive layer 116 may also be applied in situ to a roll of laminate material as it is unwound to provide the combination of adhesive layer 116 and bottom laminate 115. Alternatively, adhesive layer 116 may be applied to the corresponding location on the web or sheet 111. In any case, adhesive 116 is intended to be a permanent adhesive, as opposed to a peel interface or a transfer adhesive.

Web 111 is turned over using turn bar apparatus 129 so that bottom laminate segments 128 face downward. A roll of top material 130 comprising laminate layer 112 and adhesive layer 113 is fed, cut-off, and applied, again using well-known apparatus, so that top laminate segments 131 are applied essentially in register with the bottom laminate segments 128 on the other side of web 111. Adhesive 113 is a permanent adhesive which may be applied in situ to the top laminate 112 using well known coating equipment as are available from ITW Dynatech of Hendersonville, Tenn.

The web 111, with bottom segments 128 and top laminate segments 131, proceeds to a rotary die cutting station 132 widely used in web finishing equipment. Of course, other types of die-cutting equipment could be used, such as a reciprocating, flat bed die-cutter. The rotary die-cutting station 132 includes a magnetic die cylinder 133, flexible magnetic dies 134 which are placed advantageously on the magnetic die cylinder 133, and adhered magnetically, and a cooperating anvil cylinder 135. Alternatively, the magnetic die cylinder 133 and dies 134 may be combined to provide an engraved die-cutting cylinder. The magnetic dies 134 include the disclosed microperforations configured to fully cut through the top segment 131, the web 111, and substantially microperforate the bottom segment 128. The die-cutting station 132 cooperates with the web 111 in order to die-cut the top segment 131, the web 111 and bottom segment 128 (in that order), as described previously, to define the inventive integral card portion 120.

The web 111, equipped with bottom segments 128, top segments 131, and die-cut to form inventive integral card portions 120, maybe further conveyed and processed to provide folded packs, such as illustrated at 145, individual sheets 146, rolls 147, or into another apparatus such as forms collator, or printing means such as ink jet, laser, flexo, offset, or other known processes.

Having thus disclosed in detail a preferred embodiment of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

I claim:

1. In an integrated card assembly, the combination comprising:

a sheet having first and second sides, a sheet thickness, and a sheet perimeter;

a back laminate affixed permanently to a portion of said second side of said sheet, within said sheet perimeter, said back laminate having a laminate thickness and a laminate perimeter;

a perimetric microperforation die-cut within said laminate perimeter, said microperforation die-cut defining at least a major portion of the perimeter of a removable card, and a border remaining outside of said card perimeter;

said microperforation die-cut characterized by a plurality of first cuts of a first depth extending though substantially all of one of said sheet and said laminate but not the other, and a plurality of second cuts of a second depth extending through all of both of said laminate and said sheet;

said first and second cuts occurring in alternate succession about said card perimeter for at least a substantial portion thereof.

2. The card assembly of claim 1 wherein the repetition rate of said second cuts is greater than about thirty per inch and the spacing of said second cuts defines the width of ties extending between said removable card and the other of said sheet and back laminate, and wherein said width is less than about 5 mils.

3. The card assembly of claim 1 further comprising a top laminate affixed to said first side of said sheet and wherein said first and second cuts extend entirely through said top laminate.

4. The card assembly of claim 1 further characterized in that said card assembly is free of a peel interface between said sheet and said back laminate.

5. The integrated card assembly of claim 1 wherein said first and second cuts define a plurality of ties in one of said sheet and said back laminate, said ties bridging between said removable card and said border, and wherein said card is retained by said ties, and characterized in that said card can be readily removed by tearing said ties along said microperforation, and the perimeter of said card appears smooth and feels smooth to the touch when said card is removed.

6. The integrated card assembly of claim 5 further characterized in that the width of said ties is less than about 5 mils and that the cross sectional area of said ties is less than about 10 square mils.

7. The integrated card assembly of claim 1 wherein said back laminate is affixed directly to said second side of said sheet, and a portion of said card perimeter has a continuous cut extending substantially through both of said sheet and said back laminate to provide a location to initiate removal of said card.

8. The integrated card assembly of claim 1 wherein said card perimeter is substantially rectangular and having at least one rounded corner, said rounded corner having a continuous cut substantially through both of said sheet and said back laminate to provide a location to initiate the removal of said card.

9. The integrated card assembly of claim 4 wherein said microperforation extends substantially the entire length of the edges of said card perimeter, except for the corners thereof.

10. The integrated card assembly of claim 1 wherein said microperforation is formed by a series of alternate cuts and notches in a cutting edge of a die selected from the group of a flexible steel die and an engraved cylinder die, said notches forming ties in said card, the width of said ties being in the range of approximately 1 mil to approximately 5 mils.

11. The integrated card assembly of claim 10 wherein the depth of said ties is in the range of approximately 1 mil to approximately 5 mils and the cross sectional area of said ties is less than about 10 square mils.

12. The integrated card assembly of claim 10 wherein the depth of said ties is approximately equal to the width of said ties.

13. The integral card assembly of claim 10 wherein the thickness of said ties is different than the width of said ties.

14. In an integrated card assembly, the combination comprising:

a sheet having first and second sides, a sheet thickness, and a sheet perimeter, a first laminate affixed permanently to a portion of said first side of said sheet, within said sheet perimeter, said first laminate having a first laminate thickness and a first laminate perimeter, a second laminate affixed permanently to a portion of said second side of said sheet, within said sheet perimeter, said second laminate having a second laminate thickness and a second laminate perimeter, said second laminate substantially underlying said first laminate, a perimetric microperforation die-cut within said first and second laminate perimeters, said die-cut defining a removable card having a card perimeter and a border, said die-cut characterized by a plurality of alternate first and second cuts, said first cuts extending continuously through substantially all of said first laminate and said sheet, said second cuts extending through substantially all of said first laminate, sheet and second laminate.

15. The integrated card assembly of claim 14 wherein said first laminate is affixed directly to said first side of said sheet, and wherein said first and second cuts define a plurality of ties in one of said laminates, said ties bridging between said removable card and said border, and wherein said card is retained by said ties, and characterized in that said card can be readily removed by tearing said ties along said microperforation and the perimeter of said card appears smooth and feels smooth to the touch when said card is removed.

16. The integrated card assembly of claim 14 wherein a portion of said card perimeter has a continuous cut extending substantially through both of said laminates and said sheet to provide a location to initiate removal of said card.

17. The integrated card assembly of claim 14 wherein said card perimeter is substantially rectangular with a radius rounding at least one corner, said radius having a continuous cut substantially through both of said laminates and said sheet to provide a location to initiate the removal of said card.

18. The integrated card assembly of claim 14 wherein said microperforations extend substantially the entire perimeter of said card, except for the corners thereof.

19. The integrated card assembly of claim 14 wherein said microperforations are formed by a series of alternate cuts and notches from one of a flexible steel die and an engraved die cylinder, said notches forming ties in said card, the width of said ties being in the range of approximately 1 mil to approximately 5 mils.

20. The integrated card assembly of claim 19 wherein the thickness of said ties is in the range of approximately 1 mil to approximately 5 mils and the cross sectional area of said ties is less than about 10 square mils.

21. The integrated card assembly of claim 19 wherein the thickness of said ties is approximately equal to the width of said ties.

22. The integral card assembly of claim 19 wherein the thickness of said ties is different than the width of said ties.

23. The integrated card assembly of claim 14 further comprising a plurality of sheets connected end-to-end.

24. In an integrated card business form, the combination comprising:

a form ply having first and second sides;

a laminate having a first side affixed directly to said second side of said form ply, said laminate further having a second side, a thickness and a perimeter;

a die-cut of closed configuration forming a removable card within said perimeter of said laminate to define the perimeter of said card and a border, and including a series of alternating first and second cuts along at least a portion of the perimeter of said die-cut, said first cuts extending substantially entirely through said form ply and said laminate, said second cuts extending at least substantially entirely through said form ply to a distance in the range from approximately 1 mil to approximately 5 mils from said second side of said laminate, thereby to define ties holding said card to said border of said laminate during processing and characterized in that said card may be readily separated when it is desired to remove said card from said form and that the cross sectional area of said ties is less than about 10 square mils.

25. The business form of claim 24 wherein the width of said ties is in the range of approximately 1 mil to 5 mils and said width of said ties is approximately equal to the thickness thereof, and said ties are formed at a repetition rate of at least thirty per inch.

* * * * *